US006712741B1

(12) United States Patent
McDonald

(10) Patent No.: US 6,712,741 B1
(45) Date of Patent: Mar. 30, 2004

(54) WATER EXERCISE DEVICE AND METHOD

(76) Inventor: H. Clayton McDonald, P.O. Box 1500, Arcadia, FL (US) 33821

( * ) Notice: Subject to any disclaimer, the term of this patent is extended or adjusted under 35 U.S.C. 154(b) by 716 days.

(21) Appl. No.: 09/212,343

(22) Filed: Dec. 15, 1998

Related U.S. Application Data

(63) Continuation of application No. 08/853,434, filed on May 9, 1997, now Pat. No. 5,921,898.

(51) Int. Cl.[7] ..... A63B 21/008
(52) U.S. Cl. ..... 482/111; 482/55; 482/106
(58) Field of Search ..... 482/111, 55, 106; 441/106, 108, 113–115, 117, 87–88, 125–127, 80, 120, 121, 126, 132, 136

(56) References Cited

U.S. PATENT DOCUMENTS

| | | | | | |
|---|---|---|---|---|---|
| 346,599 | A | * | 8/1886 | McDonald | 441/120 |
| 728,745 | A | | 5/1903 | Morrison | |
| 1,273,687 | A | | 7/1918 | Stebbing | |
| 1,803,095 | A | * | 4/1931 | Cole | 441/120 |
| 3,084,358 | A | | 4/1963 | McLean | |
| 4,011,614 | A | | 3/1977 | Bell | |
| 4,276,670 | A | | 7/1981 | Marchello et al. | |
| 4,689,030 | A | | 8/1987 | McWaters | |
| 4,986,786 | A | * | 1/1991 | Helt et al. | 441/120 |
| 5,092,802 | A | | 3/1992 | Jones | |
| 5,348,505 | A | | 9/1994 | Rothhammer | |
| 5,516,320 | A | | 5/1996 | LaPlant | |
| 5,588,891 | A | | 12/1996 | Bardot | |
| 5,921,898 | A | * | 7/1999 | McDonald | 482/111 |

* cited by examiner

*Primary Examiner*—Nicholas D. Lucchesi
*Assistant Examiner*—L Amerson
(74) *Attorney, Agent, or Firm*—Allen, Dyer, Doppelt, Milbrath & Gilchrist, P.A.

(57) ABSTRACT

An exercise device for use in water is made of a buoyant material and can support a user positioned in a body of water. Two opposed end portions are connected by a narrowed central portion that is dimensioned to fit between the upper leg portions of the user. In use, the user places the central portion between the legs, causing the end portions to be buoyed upward and enveloping the user's trunk. Positioned thus, the user is supported in an upright position with the limbs free to move, which is suitable for performing an exercise.

5 Claims, 1 Drawing Sheet

WATER EXERCISE DEVICE AND METHOD

CROSS REFERENCE TO RELATED APPLICATION

This application is a continuation of application Ser. No. 08/853,434 filed May 9, 1997 now U.S. Pat. No. 5,921,898, commonly owned with the present invention.

BACKGROUND OF THE INVENTION

1. Field of the Invention

The present invention relates to floating devices for use in the water, and, more particularly, to floating devices for use in exercise programs in the water.

2. Description of Related Art

Water flotation devices are well known in the art, including life vests, tubes, boards, and "water wings."

However, none of the known devices are adapted for use during water exercising, since all interfere with the arms, the legs, or both. Also, some of them do not ensure that the head is kept above water without some action by the arms or legs.

SUMMARY OF THE INVENTION

It is therefore an object of the present invention to provide a device for use in the water that supports the user in an upright position.

It is an additional object to provide such a device that does not hamper user movement.

It is another object to provide such a device that requires no straps or belts.

These and other objects are achieved by the device of the present invention, a water exercise device that keeps the user in an upright position while in the water.

The exercise device comprises a material adapted for floating that has two opposed end portions that together have sufficient buoyancy to support a user positioned in a body of water. The device also has a narrowed central portion in connecting relation to the two end portions. The central portion is dimensioned to fit between the upper leg portions of the user. In use the user places the central portion between the legs, causing the end portions to be buoyed upward. Thus the trunk of the user becomes enveloped by the end portions, and the user is thereby supported in an upright position. Such a position is suitable for performing an exercise, as the head is supported above the water surface and the hands and legs are free.

The method of the present invention comprises the steps of providing an exercise device as outlined above. The central portion is positioned between the legs, either while in the water or prior to entering the water. Once the water is entered and the device positioned as defined, the end portions envelop the user's trunk, enabling an exercise to be performed without fear of drowning and without interfering with the movement of the limbs.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
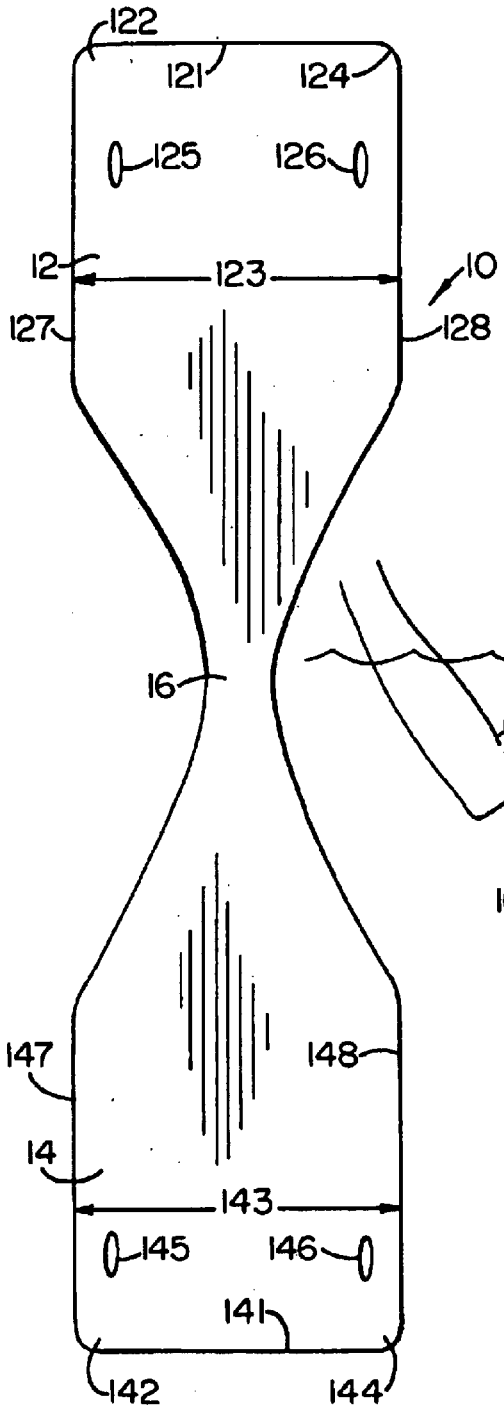
FIG. 1 is a plan view of the water exercise device in an open position.
Figure 2:
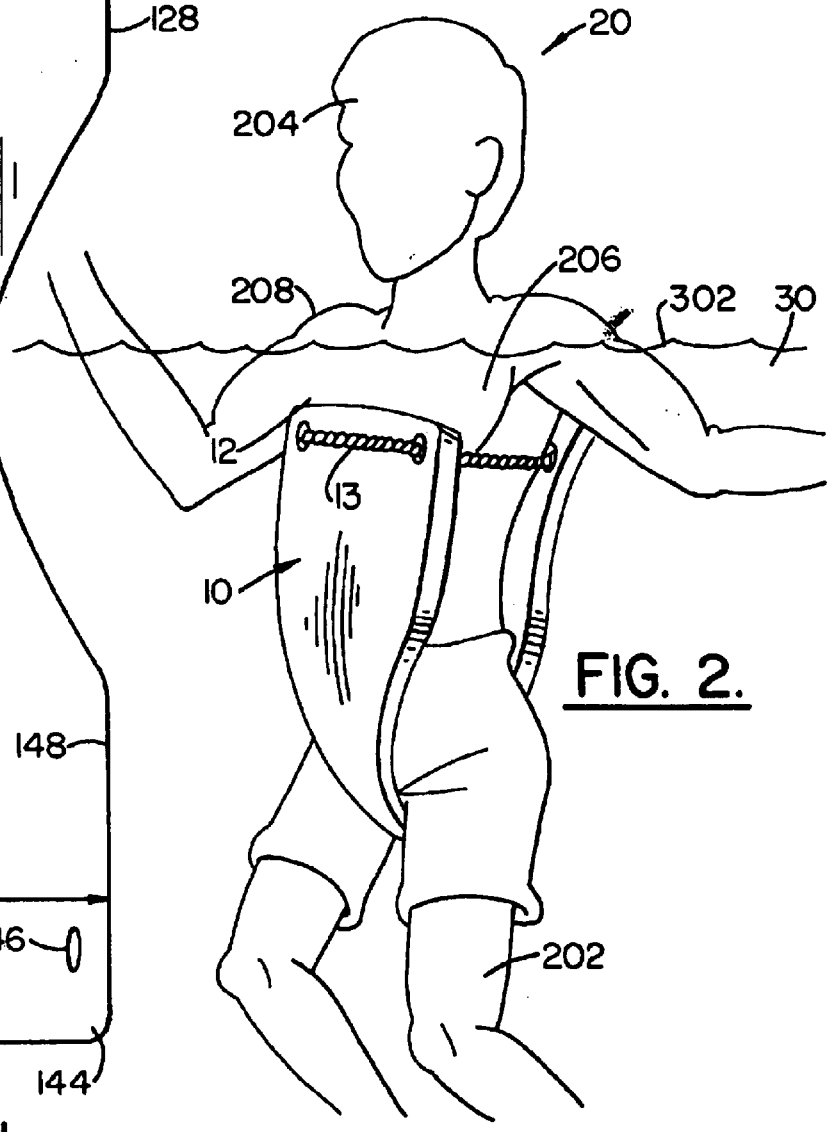
FIG. 2 is a perspective view of the device in use.

A description of the preferred embodiments of the present invention will now be presented with reference to FIGS. 1 and 2.

The exercise device 10 of the present invention is shown in plan view in FIG. 1 and in use in FIG. 2. In a preferred embodiment, the device 10 is a unitary member and comprises a foam material such as closed-cell foam or other types of flotation material. At least a portion of the material of which the device 10 is made must be adapted for floating, since the device 10 must have sufficient buoyancy to support a user 20 positioned in a body of water 30.

The device 10 has two opposed end portions 12,14 that are generally rectangular in shape with rounded corners 122,124,142,144 and generally parallel ends 121,141. Preferably the end portions 12,14 should each have a width 123,143 generally smaller than the width of the user's torso. This feature permits free arm movement by the user.

In a first embodiment, the device 10 is usable without the addition of straps or belts. In a second embodiment, the end portions 12,14 each have a pair of generally opposed holes 125,126,145,146, with one hole positioned along the sides 127,128,147,148 of each end portion 12,14. These holes 125,126,145,146 are for the insertion and retention of a body-encircling strap 13.

The device 10 additionally has a narrowed central portion 16 that is in connecting relation to the two end portions 12,14. The central portion 16 is dimensioned to fit between the upper leg portions of the user 20. This central portion 16 is a distinguishing feature of the device 10.

The method of using this device 10 includes the steps of placing the central portion 16 between the user's legs 202 and entering a body of water 30 with the head 204 upward.

The first end portion 12 is permitted to float upward toward the chest 206 of the user 20, and the second end portion 14 is likewise permitted to float upward toward the back 208 of the user 20. Thus the exercise device 10 is positioned in supporting relation to the user 20 and retains the head 204 above the water surface 302.

When using the second embodiment of the device 10, the strap 13 is attached, either while in the water or while on land.

In this position a water exercise can be easily performed, with the limbs free.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. An exercise device for use in water by a user, the device comprising a unitary piece of material adapted for floating and having:

a buoyancy for supporting a user positioned in a body of water;

two opposed end portions having opposed sides, the end portions having sufficient length to envelop a trunk of the user; and a narrowed central portion in connecting relation to the two end portions and dimensioned to fit between the upper leg portions of the user, wherein in use the user places the central portion between the legs, causing the end portions to be buoyed upward and over the chest and back of the user, the end positions freely extending and unjoined along the sides, enveloping the trunk of the user and thereby supporting the user in an upright position suitable for supporting an exercise.

2. The exercise device recited in claim 1, wherein the material comprises a foam material.

3. The exercise device recited in claim 1, wherein the unitary piece of material comprises a foam material.

4. The exercise device recited in claim 1, wherein the end portions are generally rectangular in shape, each having a width generally smaller than a width of the user, thereby permitting free arm movement by the user.

5. The exercise device recited in claim 1, wherein the end portions each have a pair of generally opposed holes, one of the holes positioned along each side of each end portion, the holes for insertion and retention of a body-encircling strap.

* * * * *